United States Patent [19]

Thomsen

[11] 4,355,801

[45] Oct. 26, 1982

[54] ADJUSTABLE WEIGHT LIFTING HOLDING DEVICE FOR LEG LIFTING EXERCISES

[75] Inventor: Timothy A. Thomsen, Iowa City, Iowa

[73] Assignee: University of Iowa Research Foundation, Iowa City, Iowa

[21] Appl. No.: 214,484

[22] Filed: Dec. 9, 1980

[51] Int. Cl.[3] ..... A63B 21/12

[52] U.S. Cl. ..... 272/119

[58] Field of Search ..... 272/119, 94, 96, 70, 272/71, 117, 143, DIG. 4, 97; 128/25 B

[56] References Cited

U.S. PATENT DOCUMENTS

| | | | |
|---|---|---|---|
| 1,187,817 | 6/1916 | Collis | 272/70 |
| 2,408,160 | 9/1946 | Brunner | 272/96 |
| 3,278,184 | 10/1966 | Rosenbaum | 272/119 |
| 3,334,898 | 8/1967 | McCrory et al. | 272/119 |
| 3,582,067 | 6/1971 | Rucks | 272/119 |
| 3,751,031 | 8/1973 | Yamauchi | 273/143 X |
| 3,752,474 | 8/1973 | Macabet et al. | 272/97 X |
| 3,910,577 | 10/1975 | Boyle | 272/119 |

*Primary Examiner*—Richard C. Pinkham
*Assistant Examiner*—William R. Browne
*Attorney, Agent, or Firm*—James C. Nemmers; Haven E. Simmons

[57] ABSTRACT

An adjustable ankle strap for holding weights used in leg lifting exercises. The device "includes" of a single continuous strap having an adjustable fastener at its ends, the strap extending in a cross pattern through a loop affixed to a cushion that rests on top of the foot. The single strap provides a double loop, one of which fits beneath the arch of the foot with the other extending around the ankle with the cushion resting on top of the foot. A fastener is provided on the strap for attaching the desired weights.

3 Claims, 2 Drawing Figures

FIG 1
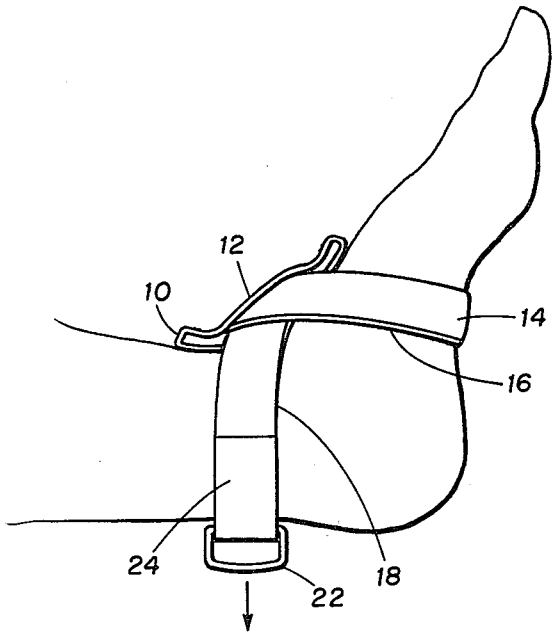
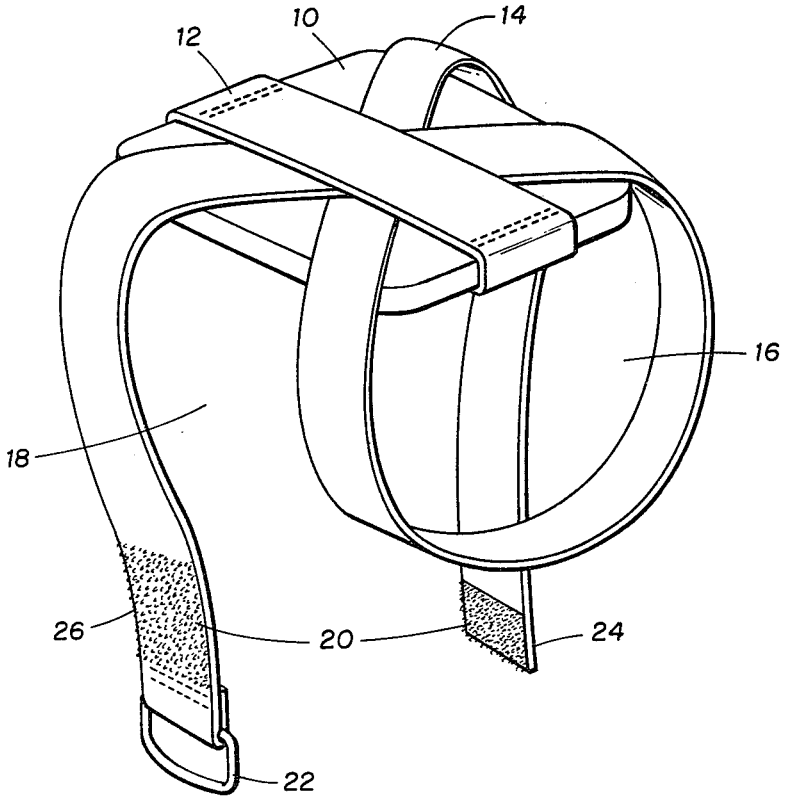
FIG 2

ADJUSTABLE WEIGHT LIFTING HOLDING DEVICE FOR LEG LIFTING EXERCISES

BACKGROUND OF THE INVENTION

Instability of the knee joint is a common ailment. Knee instability can result from an athletic injury, degenerative joint disease or from knee surgery. In order to increase the stability of the knee joint, orthopedic surgeons routinely prescribe straight-leg lifting exercises in order to strengthen the quadricep muscle. A program for straight-leg raising exercises generally includes repeated leg lifts with gradually increasing weight so that the effort required for the lift is increased as the quadricep develops.

At the present time, there are various weighted devices available which can be strapped to the ankle. However, they are combersome and inefficient. In addition, persons who perform the leg lifting exercises often use a variety of individually created ways of performing the required leg lifts. For a person on a straight-leg raising exercise program, however, there is no device available that is comfortable, inexpensive, convenient to use and which has the ability of easily varying the weight over a broad range throughout the excercise program.

SUMMARY OF THE INVENTION

The device of the invention is a very simple, inexpensive and easy to use device which has the capability of bearing weights from one pound or less to forty pounds with little or no modification. The device consists of a continuous strap that is passed around the fore foot and ankle with a cushioned pad over the dorsum of the foot for comfort and stability. The weights are attached by a hook to the heel portion of the device. The device is fully adjustable so that one size will fit any user.

BRIEF DESCRIPTION OF THE DRAWINGS

FIG. 1 is a side elevational view showing the device in place around the ankle and foot of the user; and FIG. 2 is a perspective view of the device illustrating the components of the device and their relationship.

DESCRIPTION OF THE PREFERRED EMBODIMENT OF THE INVENTION

The device of the invention consists of a cushioned pad 10 made of a suitable material sufficiently flexible to adapt to the contour of the dorsum of the foot but sufficiently rigid to minimize the pressure and distribute it over the top of the foot when the device is used. A strip of material 12 is suitably affixed at opposite ends of the pad 10 so as to form a closed loop 13 between the material 12 and the top of pad 10. A single continuous strap 14 made of suitable material, such as heavy canvas, extends through the loop 13, strap 14 being capable of holding the anticipated amount of weight without breaking.

As best seen in FIG. 2, the strap 14 is passed through the loop 13 in a cross pattern formed by passing one end of the strap 14 through the loop 13 in one direction and then returning the end of the strap through the loop 13 in the opposite direction. This forms a first or lower closed loop 16 and a second or upper open loop 18, the loop 18 being closed when the free ends of the strap 14 are joined in the manner described hereinafter.

The ends of strap 14 are provided with a suitable adjustable fastening means 20, such as a Velcro fastener.

One end of strap 14 is also provided with a closed ring 22 that serves as part of the fastening means 20 by passing the end 24 through the ring 22 and securing it to the other end 26 by means of the fastener 20. The ring 22 also serves as a means of hooking or otherwise affixing the weight to be used in providing the necessary force to perform the leg lift exercises.

FIG. 1 shows the device of the invention in place on the user's foot. As seen in FIG. 1, the pad 10 rests over the top or dorsum of the foot, and the foot extends through the lower loop 16 with the strap 14 passing across the arch of the foot. The upper loop 18 fits around the ankle. The device is easily placed on the foot by positioning the components as shown in FIG. 2, and then extending the toes through the loop 16 until the strap 14 passes beneath the arch and the pad 10 rests on the top of the foot. The free ends 24 and 26 of the strap 14 are then grasped and pulled downwardly to the rear of the ankle. The end 24 of strap 14 is then passed through the loop 22 and pulled until the device is comfortably tight. The fastener 20 is then fastened. The user should adjust the position of the strap 14 so that the ring 22 is at the back of the ankle and directly beneath the ankle when the foot is raised as shown in FIG. 1.

When thus applied to the user's foot and ankle, a weight of the desired amount can be easily hooked to the ring 22 and the exercises performed. Because the device consists of only two parts, the strap 14 and the pad 10 with the strip of material 12 attached to it, the device is very simple and inexpensive. It is obviously easy to use, and is compact and can be easily packed when the user travels. The device is fully adjustable so that one size will fit any user. Although the device has been described in connection with the preferred embodiment thereof, it will be obvious to those skilled in the art that various revisions and modifications can be made to the preferred embodiment without departing from the spirit and scope of the invention. It is my intention, however, that all such revisions and modifications as are obvious to those skilled in the art will be included within the scope of the following claims.

I claim:

1. An adjustable device for holding weights behind the user's ankle when performing leg lifting exercises, said device comprising a pad of sufficient flexibility to conform generally to the dorsum of the user's foot, means on said pad forming a fixed loop, a single continuous strap extending through said loop in one direction and back through said loop in the opposite direction to form an adjustable lower closed loop engageable with the user's foot, the free ends of said strap being closable to form an adjustable upper loop engageable with the user's ankle, fastening means providing for adjustably securing the free ends of said strap together to close the upper loop, and a ring affixed to one end of said strap to provide for fastening of a weight on the upper loop, said ring also forming a part of said fastening means for securing the free ends of said strap together.

2. The device of claim 1 in which said strap is freely movable through said fixed loop so as to provide for adjustability of said upper and lower loops by moving the free ends of said strap.

3. An adjustable device for holding weights behind the user's ankle when performing leg lifting exercises, said device comprising a pad of sufficient flexibility to conform generally to the dorsum of the user's foot, means on said pad forming a fixed loop, a single continuous strap having free ends extending through said loop in one direction and back through said loop in the opposite direction to form an adjustable lower closed loop engageable with the user's foot, the free ends of said strap being closable to form an adjustable upper loop engageable with the user's ankle and providing for attachment of a weight on the upper loop, said strap being freely movable through said fixed loop on said pad so as to provide for adjustability of said upper and lower loops by moving the free ends of said strap, and fastening means providing for adjustably securing the free ends of said strap together to close the upper loop around the ankle of the user.

* * * * *